US006418560B1

(12) United States Patent
Emechete

(10) Patent No.: US 6,418,560 B1
(45) Date of Patent: Jul. 16, 2002

(54) PROTECTIVE GLOVE FOR STRINGING A TENNIS RACKET

(76) Inventor: Valentine C. Emechete, 5026 N. Peg La., Memphis, TN (US) 38117

( * ) Notice: Subject to any disclaimer, the term of this patent is extended or adjusted under 35 U.S.C. 154(b) by 0 days.

(21) Appl. No.: 09/826,175

(22) Filed: Apr. 4, 2001

(51) Int. Cl.[7] ..... A41D 19/00
(52) U.S. Cl. ..... 2/161.4; 2/159; 2/161.1
(58) Field of Search ..... 2/161.4, 16, 20, 2/159, 160, 161.1, 161.2, 161.6, 166, 169

(56) References Cited

U.S. PATENT DOCUMENTS

| | | | | |
|---|---|---|---|---|
| 4,094,014 A | | 6/1978 | Schroeder | 2/161 R |
| 4,796,306 A | * | 1/1989 | Mitchell | 2/160 |
| 5,186,459 A | | 2/1993 | Korte-Jungermann | 273/73 A |
| 5,414,868 A | * | 5/1995 | Crawford | 2/160 |
| 5,745,919 A | | 5/1998 | Kraatz | 2/161.6 |
| 5,819,312 A | | 10/1998 | Snyder et al. | 2/16 |
| 5,853,210 A | * | 12/1998 | Robinson | 2/160 |
| 5,898,943 A | * | 5/1999 | Kim | 2/161.2 |
| 5,974,588 A | | 11/1999 | Furman | 2/159 |
| 6,006,358 A | * | 12/1999 | Keating | 2/161.1 |

* cited by examiner

*Primary Examiner*—Danny Worrell
*Assistant Examiner*—Gary L. Welch
(74) *Attorney, Agent, or Firm*—Polster, Lieder, Woodruff, & Lucchesi, L.C.

(57) ABSTRACT

A protective glove for stringing a tennis racket comprises a partial glove portion having a palm side and a backside, the partial glove portion having a thumb portion, an index finger portion, a middle finger portion, a ring finger portion, and a little finger portion adapted for receiving the fingers of a hand, the palm side comprising a tab portion having a fastening means, the backside comprising a pair of straps each having an end portion and fastening means associated with each of the end portions, the fastening means of the straps adapted for mating with the fastening means of the tab portion.

20 Claims, 4 Drawing Sheets

PROTECTIVE GLOVE FOR STRINGING A TENNIS RACKET

BACKGROUND OF THE INVENTION

This invention relates to a protective glove, and more particularly, to a protective glove which is used for stringing a tennis racket.

Tennis rackets consists of a racket frame having a handle portion and a head portion. The head portion is strung with strings which are used to contact a tennis ball during the playing or practicing of the game of tennis. In order to string the tennis racket the strings are inserted through holes which are positioned along an edge of the head portion. The strings also need to be properly tensioned and this requires pulling on the strings. Additionally, different tennis players require or prefer different tension of the strings. In order to tension the strings properly, personnel stringing the racket are required to pull on the strings. These strings are constructed of nylon or other synthetic materials and are typically less than 1 mm in diameter. As personnel are stringing, it is common for burns or abrasions to occur to the fingers, the hands, or the skin. This is especially true if a person is stringing 20 to 30 rackets per day at a large tournament or club.

Protecting the fingers or the hands while stringing a tennis racket is important. However, there is presently no device which is used for protecting the fingers, the palm, or the hands. If a protection device is to be readily acceptable by persons stringing tennis rackets, it must be able to easily protect the fingers or the hands, be easy to use, and not require any modification to the stringing process. Further, a protective glove must be comfortable to wear and convenient to use. If the protective glove impede the stringing process, then personnel may not be inclined to wear or use the protective glove.

The present invention is designed to obviate and overcome many of the disadvantages and shortcomings associated with presently available methods of stringing tennis rackets. In particular, the present invention is a protective glove which protects a user's hands, skin, and fingers when stringing a single tennis racket or a plurality of tennis rackets. Moreover, the protective glove of the present invention can be easily utilized when stringing a tennis racket and does not inhibit the stringing of a tennis racket.

SUMMARY OF THE INVENTION

In one form of the present invention, a protective glove for stringing a tennis racket comprises a partial glove portion having a palm side and a backside, the partial glove portion having a thumb portion, an index finger portion, a middle finger portion, a ring finger portion, and a little finger portion adapted for receiving the fingers of a hand, the palm side comprising a tab portion having a fastening means, the backside comprising a pair of straps each having an end portion and fastening means associated with each of the end portions, the fastening means of the straps adapted for mating with the fastening means of the tab portion.

In another form of the present invention, a protective glove for stringing a tennis racket comprises a partial glove portion having a front side and a palm side, the partial glove portion having a thumb portion, an index finger portion, a middle finger portion, a ring finger portion, and a little finger portion adapted for receiving the fingers of a hand, the front side comprising a tab portion having a fastening means, the palm side comprising a pair of straps each having an end portion and fastening means associated with each of the end portions, the fastening means of the straps adapted for mating with the fastening means of the tab portion.

In yet another form of the present invention, a pair of protective gloves for use in stringing a tennis racket comprises pair of protective gloves for use in stringing a tennis racket comprising a first glove which comprises a partial glove portion having a palm side and a backside, the partial glove portion having a thumb portion, an index finger portion, a middle finger portion, a ring finger portion, and a little finger portion adapted for receiving the fingers of a hand, the palm side comprising a tab portion having a fastening means, the backside comprising a pair of straps each having an end portion and fastening means associated with each of the end portions, the fastening means of the straps adapted for mating with the fastening means of the tab portion and a second glove which comprises a partial glove portion having a front side and a palm side, the partial glove portion having a thumb portion, an index finger portion, a middle finger portion, a ring finger portion, and a little finger portion adapted for receiving the fingers of a hand, the front side comprising a tab portion having a fastening means, the palm side comprising a pair of straps each having an end portion and fastening means associated with each of the end portions, the fastening means of the straps adapted for mating with the fastening means of the tab portion.

In light of the foregoing comments, it will be recognized that a principal object of the present invention is to provide a protective glove for stringing a tennis racket which is of simple construction and design and which can be easily employed with highly reliable results.

Another object of the present invention is to provide a protective glove for stringing a tennis racket that is of unitary construction.

A further object of the present invention is to provide a protective glove that is made of a relatively lightweight material so that it can be easily positioned on a user, secured in place, and easily removed when the stringing process is completed.

Another object of the present invention is to provide a protective glove which is flexible and easy to use.

A still further object of the present invention is to provide a pair of protective gloves which are comfortable to wear, provide protection from abrasions or burns associated with stringing a tennis racket, and provide improved gripping capability.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
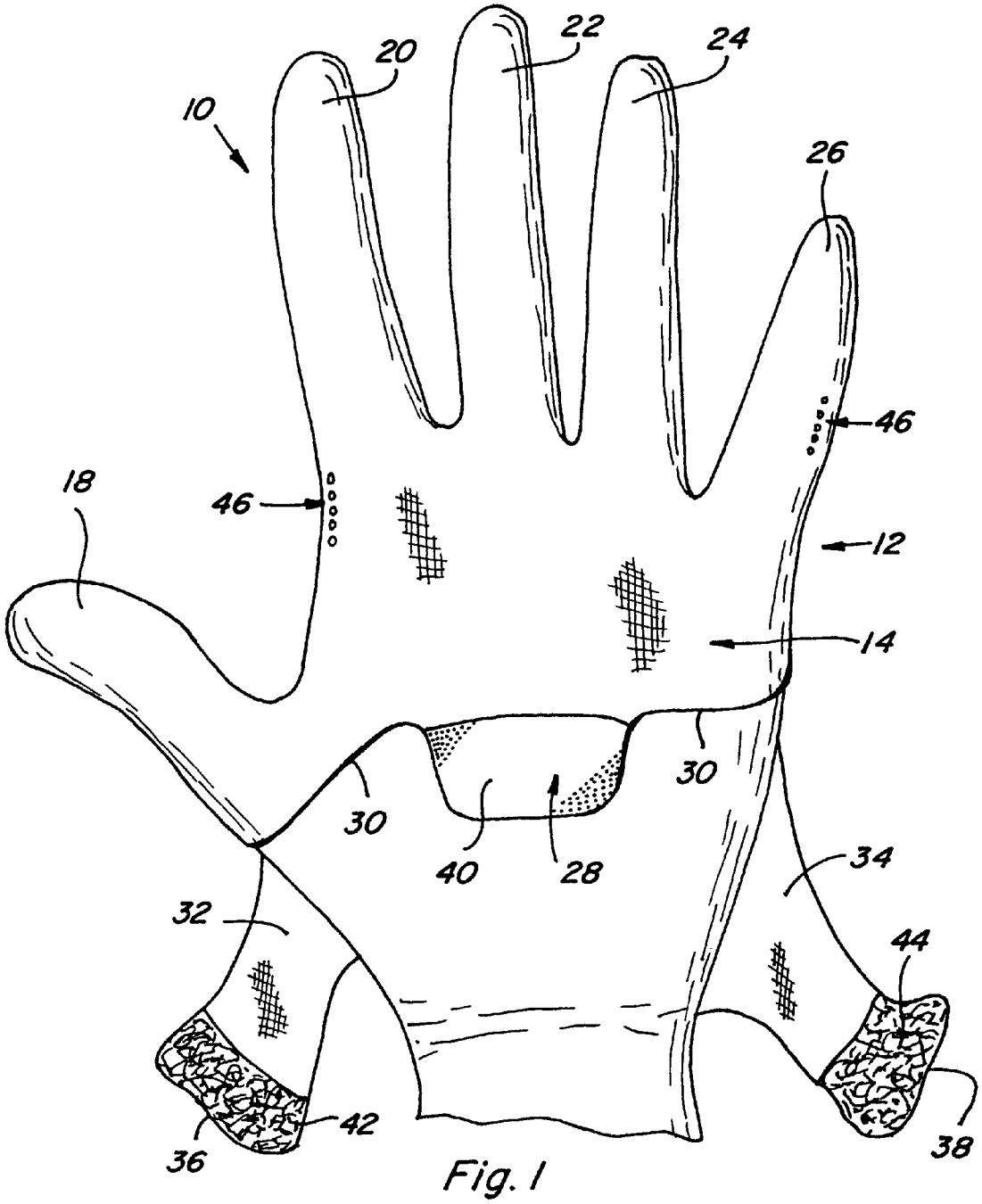
FIG. 1 is a front perspective view of a preferred embodiment of a protective glove constructed according to the present invention.
Figure 2:
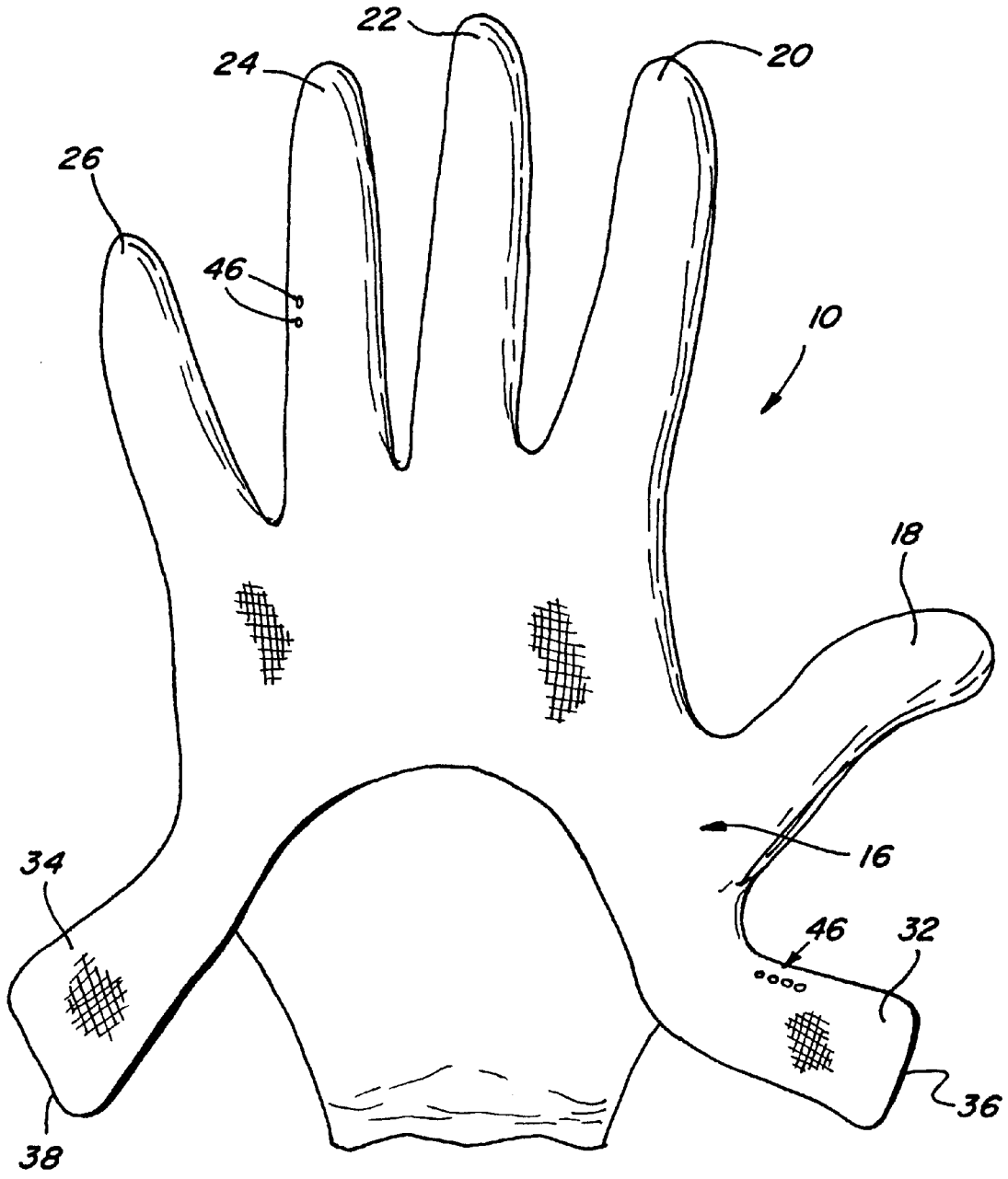
FIG. 2 is back perspective view of the protective glove shown in FIG. 1.

Referring now to the drawings, wherein like numbers refer to like items, number 10 identifies a preferred embodiment of a protective glove constructed according to the present invention. With reference now to FIGS. 1 and 2, the protective glove 10 is shown comprising a partial glove portion 12 having a palm side 14 and a backside 16. The palm side 14 and the backside 16 are asymmetrical in shape and construction. Since the glove 10 consists of an asymmetrical design and construction, another glove, not shown, will be needed for the other hand of a user. For example, the glove 10 may be a left handed glove and the other glove would be a right handed glove. The partial glove portion 12 has a thumb portion or stall 18, an index finger portion or stall 20, a middle finger portion or stall 22, a ring finger portion or stall 24, and a little finger portion or stall 26. The palm side 14 has a tab portion 28 which is centrally positioned along a lower edge 30 of the partial glove portion 12. The backside 16 has a pair of straps 32 and 34 which are adapted to be releasably secured to the tab portion 28. The straps 32 and 34 each have an end portion 36 and 38, respectively. The tab portion 28 includes a fastening means 40 and the end portions 36 and 38 each include a fastening means 42 and 44, respectively. In particular, the fastening means 40, 42, and 44 may include Velcro®, a snap, a button, or a temporary adhesive. However, in the preferred embodiment, the fastening means is a hook and loop type fastener such as Velcro®.

The straps 32 and 34 are attached to the tab portion 28 by use of the fastening means 40, 42, and 44. Once the straps 32 and 34 are attached to the tab portion 28 the glove 10 is held in place on a hand of a user. The straps 32 and 34 hold the glove 10 in place during the process of stringing a tennis racket. The straps 32 and 34 are easily disengaged from the tab portion 28 when a user is finished stringing a tennis racket. Additionally, the straps 32 and 34 need to be removed from the tab portion 28 in order to remove the glove 10 from the hand of the user.

The glove 10 may be constructed from a sheet of flexible material such as leather, spandex, lycra, nylon, or other equivalent material. The flexible material may be of a suitable thickness to allow a person stringing a tennis racket to still feel the string, which is typically less than 1 mm in diameter. The flexible material may also be elastic in nature to allow the glove 10 to easily fit around a hand. The palm portion 14 and the backside 16 may be separate pieces of material which are stitched together to form the glove 10. Further, the glove 10 may include perforations 46 throughout to provide comfort to the user when stringing the tennis racket The glove 10 may also be constructed of a mesh material. As can be appreciated, the palm side 14 protects the palm of the hand of the user when stringing a tennis racket. The palm side 14 also provides a gripping surface with which to grip and hold the string.

Although not shown, the straps 32 and 34 may further include other fastening means, similar to the fastening means 40, 42, and 44, on the side opposite from which the fastening means 42 and 44 are located. In this arrangement the other fastening means may be used to releasably attach the straps 32 and 34 to each other in order to obtain a more secure grip or fit around the hand of the user.

Figure 3:
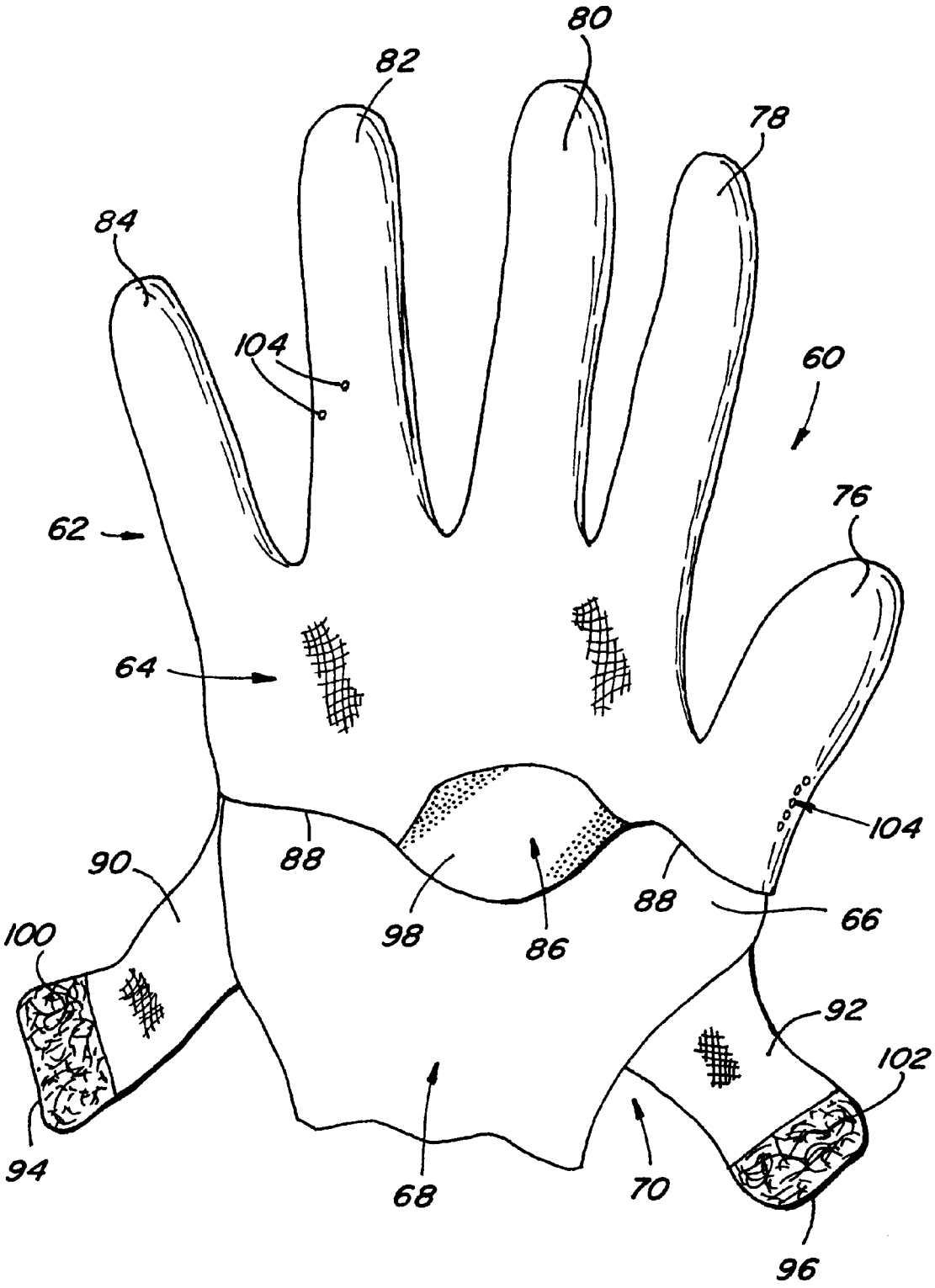
FIG. 3 is a front perspective view of another preferred embodiment of a protective glove constructed according to the present invention.
Figure 4:
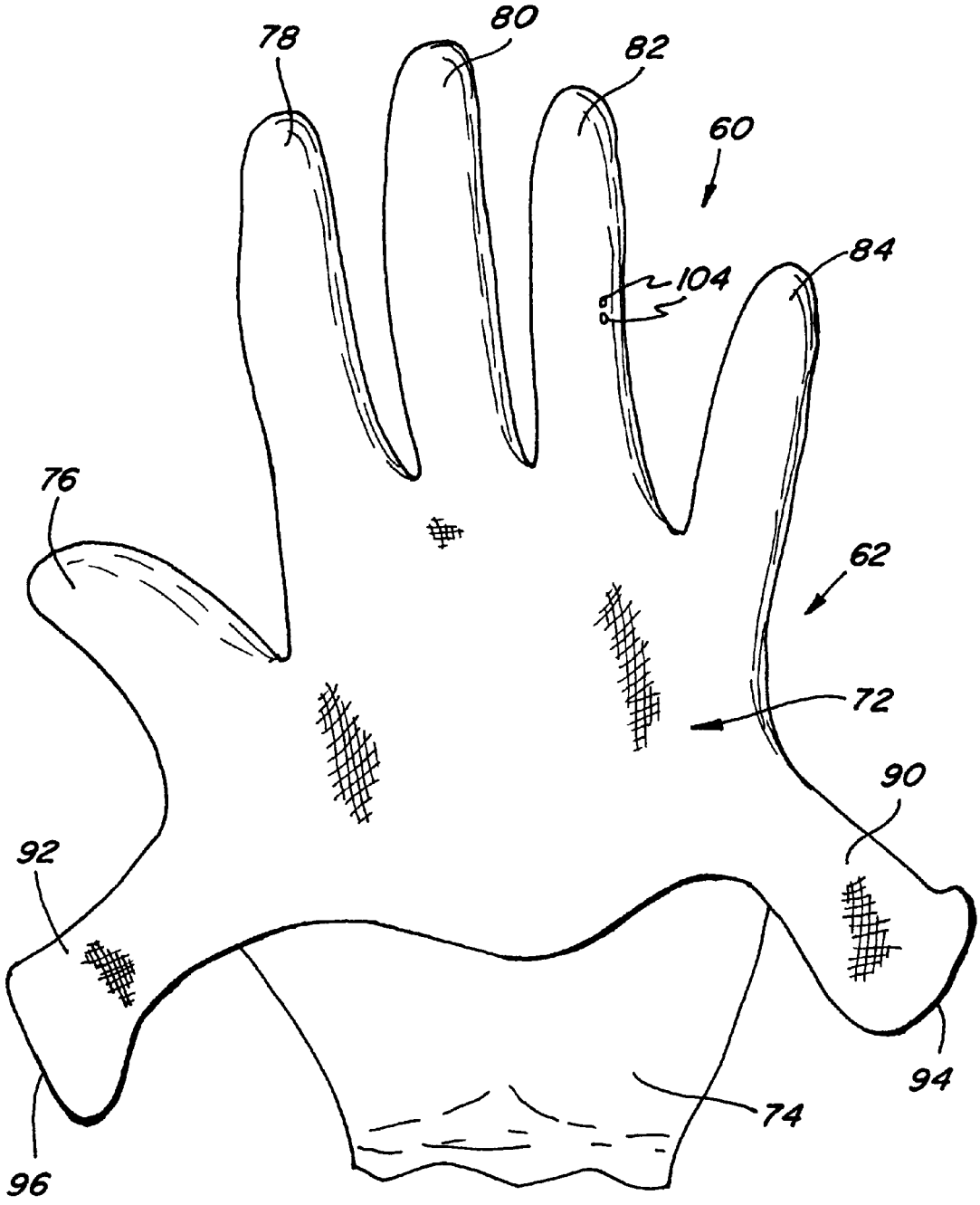
FIG. 4 is a back perspective view of the protective glove shown in FIG. 3.

With reference now to FIGS. 3 and 4, another preferred embodiment of a protective glove 60 for stringing a tennis racket is shown. The protective glove 60 comprises a partial glove portion 62 having a front side 64 which partially covers a backside 66 of a hand 68 of a user 70 and a palm side 72 which partially covers a palm 74 of the hand 68. The front side 64 and the palm side 72 asymmetrical in shape and construction. Since the glove 60 consists of an asymmetrical design and construction, another glove, not shown will be needed for the other hand of the user 70. The partial glove portion 62 has a thumb portion or stall 76, an index finger portion or stall 78, a middle finger portion or stall 80, a ring finger portion or stall 82, and a little finger portion or stall 84. The front side 64 has a tab portion 86 that is centrally positioned along a lower edge 88 of the partial glove portion 62. The palm side 72 has a pair of straps 90 and 92 which are adapted to be releasably secured to the tab portion 86. The straps 90 and 92 each have an end portion 94 and 96, respectively. The tab portion 86 includes a fastening means 98 and the end portions 94 and 96 each include a fastening means 100 and 102, respectively. The fastening means 98, 100, and 102 may include Velcro®, a snap, a button, or a temporary adhesive. However, in the preferred embodiment, the fastening means 98, 100, and 102 are a hook and loop type fastener such as Velcro®.

The straps 90 and 92 are attached to the tab portion 86 by use of the fastening means 98, 100, and 102. Once the straps 90 and 92 are attached to the tab portion 86 the glove 60 is held in place on the hand 68 of the user 70. The straps 90 and 92 hold the glove 60 in place during the process of stringing a tennis racket. The straps 90 and 92 are easily disengaged from the tab portion 86 when the user 70 is finished stringing a tennis racket. Additionally, the straps 90 and 92 need to be removed from the tab portion 86 in order to remove the glove 70 from the hand 68 of the user 70.

The glove 60 may be constructed from a sheet of flexible material such as leather, spandex, lycra, nylon, or other equivalent material. The front side 64 and the palm portion 72 may be separate pieces of material which are stitched together to form the glove 60. Further, the glove 60 may include perforations 104 throughout to provide comfort to the user 70 when stringing the tennis racket.

The straps 90 and 92 may also include other fastening means, similar to the fastening means 98, 100, and 102, on the side opposite from which the fastening means 100 and 102 are located. In this arrangement the other fastening means may be used to releasably attach the straps 90 and 92 to each other in order to obtain a more secure grip or fit around the hand 68 of the user 70.

It should be recognized that the protective glove 10 or 60 of the present invention can be constructed of various materials and can be assembled from separable components. Preferably, the protective glove 10 will be of relatively lightweight material so that it can be easily assembled, positioned, employed, secured in place, and removed. Further, the protective glove 10 or 60 will be constructed of relatively inexpensive materials and components. Additionally, the protective glove of the present invention may be of different colors, combinations of colors, and patterns to present a fanciful image. The protective glove of the present invention may also include logos or other advertisements printed thereon. It is also possible for the user 70 to wear the glove 10 on one hand and the glove 60 on the other hand when stringing a tennis racket.

From all that has been said, it will be clear that there has thus been shown and described herein a protective glove for stringing a tennis racket which fulfills the various objects and advantages sought therefor. It will become apparent to those skilled in the art, however, that many changes, modifications, variations, and other uses and applications of the subject protective glove for stringing a tennis racket are possible and contemplated. All changes, modifications, variations, and other uses and applications which do not depart from the spirit and scope of the invention are deemed to be covered by the invention, which is limited only by the claims which follow.

What is claimed is:

1. A protective glove for stringing a tennis racket comprising a partial glove portion having a palm side and a backside, the partial glove portion having a thumb portion, an index finger portion, a middle finger portion, a ring finger portion, and a little finger portion adapted for receiving the fingers of a hand, the palm side comprising a lower edge having a tab portion extending out from and below the lower edge, the tab portion having a fastening means, the backside comprising a pair of straps each having an end portion and fastening means associated with each of the end portions, the fastening means of the straps adapted for mating with the fastening means of the tab portion.

2. The protective glove of claim 1 wherein the partial glove portion further comprises perforations.

3. The protective glove of claim 1 wherein the palm side and the backside are asymmetrical.

4. The protective glove of claim 1 wherein the fastening means is a hook and loop type fastener.

5. The protective glove of claim 1 wherein the partial glove portion comprises a flexible material.

6. The protective glove of claim 1 wherein one of the straps further comprises fastening means on another side of the strap.

7. The protective glove of claim 1 wherein the tap portion is centrally located on the lower edge.

8. A protective glove for stringing a tennis racket comprising a partial glove portion having a front side and a palm side, the partial glove portion having a thumb portion, an index finger portion, a middle finger portion, a ring finger portion, and a little finger portion adapted for receiving the fingers of a hand, the front side comprising a tab portion having a fastening means, the palm side comprising a pair of straps each having an end portion and fastening means associated with each of the end portions, the fastening means of the straps adapted for mating with the fastening means of the tab portion, and one of the straps further comprises fastening means on another side of the strap.

9. The protective glove of claim 8 wherein the partial glove portion further comprises perforations.

10. The protective glove of claim 8 wherein the front side and the palm side are asymmetrical.

11. The protective glove of claim 8 wherein the fastening means is a hook and loop type fastener.

12. The protective glove of claim 8 wherein the partial glove portion comprises a flexible material.

13. The protective glove of claim 8 wherein the front side has a lower edge and the tab portion is centrally located on the lower edge.

14. The protective glove of claim 8 wherein the other one of the straps further comprises fastening means on another side of the strap.

15. A pair of protective gloves for use in stringing a tennis racket comprising a first glove which comprises a partial glove portion having a palm side and a backside, the partial glove portion having a thumb portion, an index finger portion, a middle finger portion, a ring finger portion, and a little finger portion adapted for receiving the fingers of a hand, the palm side comprising a tab portion having a fastening means, the backside comprising a pair of straps each having an end portion and fastening means associated with each of the end portions, the fastening means of the straps adapted for mating with the fastening means of the tab portion, one of the straps further comprising fastening means on another side of the strap, and a second glove which comprises a partial glove portion having a front side and a palm side, the partial glove portion having a thumb portion, an index finger portion, a middle finger portion, a ring finger portion, and a little finger portion adapted for receiving the fingers of a hand, the front side comprising a tab portion having a fastening means, the palm side comprising a pair of straps each having an end portion and fastening means associated with each of the end portions, the fastening means of the straps adapted for mating with the fastening means of the tab portion.

16. The pair of protective gloves of claim 15 wherein each of the partial glove portions further comprises perforations.

17. The pair of protective gloves of claim 15 wherein the fastening means is a hook and loop type fastener.

18. The pair of protective gloves of claim 15 wherein each of the partial glove portions comprises a flexible material.

19. The pair of protective gloves of claim 15 wherein the palm side of the first glove has a lower edge and the tab portion is centrally located on the lower edge.

20. The pair of protective gloves of claim 15 wherein the front side of the second glove has a lower edge and the tab portion is centrally located at the lower edge.

* * * * *